US007128243B2

(12) United States Patent
Fallaha

(10) Patent No.: US 7,128,243 B2
(45) Date of Patent: Oct. 31, 2006

(54) INTEGRATED DRIP PROOF STOPPER SYSTEM

(76) Inventor: Khalil M. Fallaha, 116 DeMott Ave., Clifton, NJ (US) 07011

( * ) Notice: Subject to any disclaimer, the term of this patent is extended or adjusted under 35 U.S.C. 154(b) by 78 days.

(21) Appl. No.: 10/849,308

(22) Filed: May 19, 2004

(65) Prior Publication Data

US 2005/0258130 A1 Nov. 24, 2005

(51) Int. Cl.
*B67D 1/16* (2006.01)

(52) U.S. Cl. ..... 222/108; 215/246

(58) Field of Classification Search ..... 215/246, 215/256, 270, 258, 392; 222/108, 571, 111
See application file for complete search history.

(56) References Cited

U.S. PATENT DOCUMENTS

| | | | | | |
|---|---|---|---|---|---|
| 447,635 | A | * | 3/1891 | Day | 215/392 |
| 571,088 | A | * | 11/1896 | Hamilton | 215/392 |
| 811,742 | A | | 2/1906 | Petrie | |
| 1,182,993 | A | | 5/1916 | Deeks | |
| 3,063,590 | A | | 11/1962 | Hopkins | 215/100.5 |
| 3,927,784 | A | * | 12/1975 | Cochrane | 215/256 |
| 3,971,955 | A | | 7/1976 | Heyer et al. | 250/507 |
| 4,109,816 | A | * | 8/1978 | Faulstich | 215/256 |
| 5,207,341 | A | | 5/1993 | Yeager | 215/334 |
| 5,273,182 | A | | 12/1993 | Laybourne | 220/740 |
| 5,277,324 | A | | 1/1994 | Cash | 215/100.5 |
| 5,743,458 | A | | 4/1998 | French | 229/87.03 |
| 5,908,256 | A | | 6/1999 | Bernstein | 401/205 |
| 6,112,749 | A | | 9/2000 | Hall et al. | 128/898 |
| 6,244,309 | B1 | | 6/2001 | Martin | 141/39 |
| 6,325,247 | B1 | * | 12/2001 | Iggulden | 222/108 |

FOREIGN PATENT DOCUMENTS

| | | |
|---|---|---|
| DE | 4204341 | 6/1992 |
| FR | 2614274 | 1/1987 |
| FR | 2611659 | 3/1987 |
| FR | 2738549 | 9/1995 |
| GB | 2224260 | 10/1988 |

OTHER PUBLICATIONS

Drip Stopper Ring—Black, www.sorbentproducts.com.
Foil Cutters, Drip Collars, Filters, Chillers & Gadgets, www.wineaccessory.com.

* cited by examiner

*Primary Examiner*—Lien M. Ngo
(74) *Attorney, Agent, or Firm*—Ernest D. Buff & Associates, LLC; Ernest D. Buff; Theodore J. Pierson

(57) ABSTRACT

An Integrated Drip Proof Stopper System for wine and other liquid-containing bottles is installed during the manufacture of the bottle. The Integrated drip Proof Stopper System contains a shrink-wrap shell disposed about the throat of the bottle. The shrink-wrap shell has an opening strip that separates a shrink-wrap shell extension from a lower portion of the shrink-wrap shell. When pulled, the strip exposes an absorbent pad that is adhesively bonded to the bottom portion of the shrink-wrap shell. The absorbent pad captures drips that occur when wine or liquid is poured from the bottle, preventing damage to tablecloths or tabletops on which the bottle is placed. The upper portion of the absorbent pad has a plurality of slits and teeth forming a teeth-like structure adapted for expansion by the user to increase drip capture efficiency.

13 Claims, 3 Drawing Sheets

INTEGRATED DRIP PROOF STOPPER SYSTEM

BACKGROUND OF THE INVENTION

1. Field of the Invention

The present invention relates to stopper for wine and liquid containing bottles; and more particularly to a drip proof stopper system that is integrated with the bottle during manufacture, and functions to prevent wine or other liquid from dripping off the sides of the bottle during and after pouring of the bottle contents.

2. Description of the Prior Art

Many approaches have been disclosed for applying a collar or blotting paper to the necks of bottles containing wine and other liquids. Such devices have attempted to prevent dripping or running of such liquids down the exterior surface of the bottle. The need to prevent liquid bottle contents from dripping on and thereby damaging a table cloths or table top beneath the bottle is readily apparent. To meet this need, collars or blotting paper have been placed on or beneath bottles.

U.S. Pat. No. 447,635 to Day, Jr. discloses an absorbent bottle collar comprised of a flexible band of blotting-paper or other bibulous material adapted to hug the neck of a bottle and a retaining device to hold it in place. The upper edge of the absorbing material may optionally be scalloped with the scallops turned outward to more effectively catch and absorb any drips present. This absorbing blotting paper is held in place by the retainer and quickly becomes very soggy. As such, the blotting paper can no longer be readily retained in place to capture additional drips. The blotting paper is attached by the user by means of wire or other retainers and is not an integral part of the wine or liquid containing bottle.

U.S. Pat. No. 811,742 to Petrie discloses a section of absorbent material having a plurality of central slits, whereby the device adheres to the neck of a bottle. Blotting paper having a circular form of construction is said to be preferred, and other suitable materials having different shapes are also disclosed as being suitable for use with the device. The blotting paper collar is held in place around the collar of the wine or liquid containing bottle and becomes soggy when it absorbs the drip and slides away rapidly without absorbing further drips. The collar is placed by the user and is not an integral part of the wine or liquid containing bottle.

U.S. Pat. No. 1,182,993 to Deeks discloses an absorbent elastic band adapted to be placed around the neck of a bottle. In this manner, dripping of the contents of the bottle down the side of the neck is said to be arrested and absorbed and effectively prevented from flowing farther down the bottle. The invention is also said to prevent marring or destruction of the bottle's label, and to avoid the collection of dirt or germs that may be transmitted by a person picking up the bottle. The soft absorbent textile fabric elastic band has to be slipped over the bottle by the user and is not an integral part of the wine or liquid containing bottle.

U.S. Pat. No. 3,063,590 to Hopkins discloses a means whereby residual drip from bottles may be limited in extent. Residual dripped liquid is thereby arrested from running down along a bottle any farther than to about the lower part of the bottle neck. The bottle body is kept dry for non-sticky grasping. With its body dry there is no residually dripped liquid on the base of the bottle to wet and/or stain any surface on which the bottle is set. Further disclosed is a slightly angled or somewhat curved or arcuate strip or portion of absorbent material characterized by a substantially longitudinally oriented slot usually somewhat nearer to one of its ends than the other. This slot has a length approximately the same as the mean width of the strip in the region at and adjacent its end from which the slot is farther removed. The device disclosed by the patent is suited for installation on a bottle until a time subsequent to the bottling operation. It is not an integral part of the bottle and has to be installed by the user. An absorbent strip has a slot through which the end without the slot is inserted to form a collar around the neck of the bottle. The collar does not hug the neck of the bottle tightly enough to capture all drips. Moreover, it tends to slide down the side of the bottle to a position that prevents or retards effective usage thereof.

U.S. Pat. No. 3,971,955 to Heyer et al. discloses a container for use in the shipment and storage of radioactive material including a wrench-type cover. The cover includes a lid and a wrench-type attachment dimensioned so as to engage the cap of an enclosed bottle and provide space in which an absorbent pad can be located. The patent discloses a system in which the absorbent material is installed in the shipment container of radioactive material long after manufacture of the container and it is not manufactured together with the container.

U.S. Pat. No. 5,207,341 to Yeager discloses a bottle for packaging beverages for individual use. The bottle comprises a wide mouth container and a closure lid. The container has a neck with a circular opening; the closure lid has a concentric inner skirt and outer skirt. The container and the closure lid have corresponding fastening means for opening and closing the container. A corresponding fastening means is respectively located on an inner circumferential area of the circular opening of the neck and on an outer circumference of the inner skirt. The outer circumferential area of the neck is smooth. The outer diameter of the outer skirt covers and protects the smooth outer circumferential area of the neck when the closure lid is fastened to the container. The device disclosed by the patent is installed on the bottle after a bottling operation. By way of contrast, the Integrated Drip Proof Stopper System is installed on the bottle during the bottling operation and the absorbent pad remains hidden from view by a shrink-wrap shell until the bottle is opened by the use.

U.S. Pat. No. 5,273,182 to Laybourne discloses a coaster for use with a beverage can, bottle or other container. The coaster is provided with an absorbent member having a seat sized to receive the bottom or foot of the container. A multiplicity of interconnected capillary spaces receive and safely retain any moisture present or forming as a condensate on and running or dripping from the container. The dripping liquid is not prevented from reaching the tablecloth or table but is captured in a coaster with absorbent pad. The disclosure of the patent is fundamentally different from that of the Integrated Drip Proof Stopper System, in that the absorption medium is integrated with the bottle during manufacture and is located at or near the mouth of a bottle or container, rather than at its base.

U.S. Pat. No. 5,277,324 to Cash discloses a bottle cover arranged for securement about an upper portion of a bottle member in a complementary relationship. The bottle cover includes a body cavity and is formed of a fluid absorbing sponge material having a head portion to receive the bottle cap therewithin. The head portion has a cylindrical cavity, including a cylindrical resilient insert arranged coextensively about an interior wall of the head portion for enhanced engagement of the bottle cap. Rotation of the bottle cap is permitted relative to the associated bottle with the sponge body arranged to absorb fluid in an overflow from the associated bottle member. The device disclosed by the patent is not operative during the transfer of liquid from the container. On the other hand, such operation is the quintessence of the Integrated Drip Proof Stopper System. Moreover, the device of the patent is not installed on a bottle until after conclusion of the manufacturing procedure. By way of contrast, the Integrated Drip Proof Stopper System is especially suited for installation on the bottle during the bottling operation. Advantageously, the Integrated Drip Proof Stopper System includes an absorbent pad that remains hidden from view by a shrink-wrap shell until the bottle is opened by the user, whereas the patent device does not.

U.S. Pat. No. 5,743,458 to French discloses various embodiments of stretchable gift-wrap. Such embodiments provide for the wrapping of a portion of a regularly or irregularly shaped article to provide an attractive and closely fitting wrap therefor. The wrap is preferably formed of a finely woven, generally opaque elastic fabric materials adapted to stretch to substantially twice its unstretched dimension in all directions. Spandex materials are said to be preferable, although other stretchable materials might be used. In another embodiment, a peripheral closure band is used to draw the wrap tightly about an article. Yet another embodiment comprises a sleeve of stretchable materials, which may be open at one or both ends. The sleeve may be used to wrap elongate articles (wine bottles, etc.) therein. The corners of the closed end of the sleeve are folded and gathered to form what is said to be an attractive configuration. The patent discloses aesthetic features; not functional elements. No disclosure is contained by the patent concerning installation of the stretchable gift-wrap until after completion of the manufacturing process. By way of contrast, the Integrated Drip Proof Stopper System is adapted for installation on the bottle during the bottling operation.

U.S. Pat. No. 5,908,256 to Bernstein discloses a bottle which contains a fluid, such as a lotion (i.e., a suntan lotion, skin lotion), medication, cleanser or the like. The bottle has a built-in applicator and spout for applying the fluid to various body parts, especially inaccessible body parts such as the back of a person, to external wall surfaces and the like. The patent discloses a combined actuator and bottle for storing a fluid and for applying the fluid. Clearly, there exists no disclosure in the patent concerning a device that functions to stop drips. In contrast to the patent, wherein the built-in applicator and spout are not provided with a drip stopping mechanism, the Integrated Drip Proof Stopper System is designed to prevent drops of liquid from migrating down the bottle and coming into contact with the surface of a table, or other substrate, therebelow. Moreover, the Integrated Drip Proof Stopper System is especially suited to be installed on the bottle during the bottling operation.

U.S. Pat. No. 6,112,749 to Hall et al. discloses a method and apparatus to help infants change diets. It is based upon the use of an absorbent pad having an odorant placed on a baby bottle so as to be near the baby's nose when ingesting. This absorbent pad is neither used to curtail dribbling of liquid when baby's bottle is in use or thereafter. The inventive concept of the patent is to place a pleasing odorant near a user's nose during drinking, which can help babies, elderly people, and even pets ingest more fluids. The concept of drip stopping is not disclosed or suggested by the patent. Clearly, there exists no suggestion in the patent concerning the value derived by installing an Integrated Drip Proof Stopper System on a bottle. Even less does the patent disclose or suggest installing an Integrated Drip Proof Stopper System on a bottle during the bottling operation. By way of contrast, the Integrated Drip Proof Stopper System is especially adapted to be installed on a bottle during the bottling operation.

U.S. Pat. No. 5,908,256 to Martin discloses a filling valve for incorporation in a bottle filling machine such as the Crown bottle filling machine or other functionally similar bottle filling machines, in which the filling valve has a housing adapted so that the liquid beverage will flow through the valve orifice from a reservoir and further through a bottle scaling rubber into the bottle or other container. A drip stopper in the valve includes a slidably mounted, generally conically shaped element which in its upward position obstructs the opening for liquid flow and in its lower position provides a large annular area for rapid flow of the liquid. The drip stopper is urged with a modest force to an upward position by a spring that is overcome by the unbalanced pressure existing during the filling mode before the liquid in the container has reached the desired fill level. Clearly the drip stopper of the patent is used to help stop the flow of a liquid flowing through a valve system, rather than arrest the flow of excess liquid when poured from the mouth of a container such as a bottle. It is therefore not surprising that the patent does not disclose the advantages of the Integrated Drip Proof Stopper System, which is installed on the bottle during the bottling operation.

German Patent DE 4202341 discloses strips of blotting or similar absorbent paper placed around a bottleneck, body or base after liquid has been poured. Owing to the presence of the absorbent paper, any residual drips are completely absorbed, thus obviating any staining of the table or other surface on which the bottle rests. While providing absorptive action that mitigates residual drips, the patented device must to be manually applied either before or after opening a bottle and pouring liquid therefrom. There is no suggestion in the patent disclosure concerning an in-situ absorptive system that eliminates residual drops. Unlike the patented device, the Integrated Drip Proof Stopper System is installed on the bottle during the bottling operation.

French Patent FR 2611659 to Chincholle discloses an outer stopper cap for a bottle provided with an absorbent device comprising a skirt carrying on its inside or outside face a strip of absorbent material joined to the skirt by any appropriate means. The absorbent strip can have variable thickness, height, or shape. The device is said to eliminate liquid drops that run down the bottle's neck. The patent pertains to a replaceable bottle cap having an absorbent, replaceable inner lining. On the other hand, the Integrated Drip Proof Stopper System is provided means by which the trickling of residual droplets of liquid can be arrested and absorbed after that liquid has been poured from a container, such as a bottle and is installed during manufacture of the bottle.

French Patent FR 2614274 discloses a drop-catching device fitting on the neck of bottles or of any containers, thus preventing the flow of overflowing liquid along the whole length of the container, particularly if the latter contains oily, colored or other liquids. It comprises a sleeve or adhesive collar made of blotting paper or absorbent material fitting to the neck of the bottle or container. This collar can be printed with an advertising or other text and applied, being adhesive, either to the neck of the bottle, thus forming a stop to liquid preventing the soiling of the support where the latter is placed. This drop-catching device is applicable in all households, hospitals, laboratories, clinics or other places, the collar being considered as a disposable wrapping. What the patent does not disclose is the possibility of installing the drop-catching device at the point of filling the bottles during its manufacture and then encasing it in the casing atop the bottle.

French Patent FR 26111659 discloses an absorber of drops, which run along a bottleneck after the bottle has been poured. This absorber is composed of a semi-rigid absorbent band. A pair of concentric circular arcs spaced by a distance of between 1 and 3 cm limit the band. The band has at one of its ends a radial slot emerging on the large circular arc. At the other end of band a radial slot emerges on the small circular arc. The two slots are fit into each other to form a truncated cone that can be applied on the perimeter of the bottle zone joining the neck to the bottle body. The band can have widened ends that allow deeper slots to be made. These ends, beyond their slots have decorative patterns. The patent does not disclose a simple design and cannot be integrated into the bottle-filling production process. Rather, the presence in the patented device of interlocking slots would encourage leakage of liquid therethrough, impairing the drip stopping function. In combination with decorative portions the slots would produce a surface protrusion that would compromise the integrity of a shrink-wrap shell.

British Patent GB 2224260 discloses a piece of material that is folded, wrapped and fastened in such a way as to form a collar to fit around the neck of a container for liquid, such as a wine bottle, for the purpose of collection drips from that container when liquid is poured. It may be made from a piece of absorbent or non-absorbent materials of any color and given size, decorated or undecorated and which may be lined or unlined. The collar has at least one radially outwardly extending lip, and is fastened by press-studs, clips, Velcro or other adhesive or tied with ribbon threaded through the material. The patent discloses an absorbent collar that is fastened around the neck of a wine bottle after completion of the bottling process. By way of contrast, the Integrated Drip Proof Stopper System is installed during the bottling process, thereby greatly facilitating its use. Furthermore, there is a distinct amount of physical manipulation required before the absorbent material of the patented device becomes operatively positioned on the bottleneck. These additional manipulation procedures have been virtually eliminated by the Integrated Drip Proof Stopper System.

There remains a strong need in the art for an Integrated Drip Proof Stopper System for wine bottles and other liquid containers that is installed during the bottling process and remains hidden from view within the bottle cap and is exposed when the user opens the bottle cap, providing protection from drips ruining tablecloths and table tops. This Drip Proof Stopper System would be inexpensive to construct, easy to use, readily installed on bottles during its manufacture and aesthetically pleasing in appearance.

SUMMARY OF THE INVENTION

The present invention provides an Integrated Drip Proof Stopper System for wine bottles and other liquid containers. Advantageously, the Integrated Drip Proof Stopper System can be installed during the bottling process. It remains hidden from view within the bottle cap during shipment and storage pending use. Drip stopping elements are exposed when the user opens the bottle cap; provide protection against drips ruining tablecloths and tabletops. The Drip Proof Stopper System is aesthetically pleasing in appearance. It is inexpensive to construct, easy to use, and is readily installed on bottles during the manufacturing process.

More specifically, there is provided an Integrated Drip Proof Stopper system wherein a shrink-wrap shell forms a closure cap for a bottle containing wine or other liquid. The shrink-wrap shell surrounds the neck of the bottle when it is filled with wine or liquid during manufacture. The shrink-wrap shell overlies an absorbent pad wherein a lower portion of the absorbent pad may be attached to the shrink-wrap shell using an adhesive, preferably a polymeric glue. The absorbent pad preferably is unattached to the bottle. The shrink-wrap shell with the attached absorbent pad is held against the bottleneck by friction due to the clamping action provided by the shrink-wrap shell. The shrink-wrap shell has an opening component which preferably is a tab which, when pulled, initiates a tear along a vertical perforation along the long axis of the bottle first and then proceeds along a horizontal perforation that intersects the vertical perforation. Alternatively, the arrangement of the tab and shrink-wrap shell is such that pulling on the tab initiates a tear along a horizontal perforation tracking the horizontal axis of the bottle; the tear then proceeds along a vertical axis that intersects the horizontal perforation. The vertical and horizontal perforations are located at predetermined locations in the shrink-wrap shell resulting in the separation of a shrink-wrap extension from the lower portion of the shrink-wrap shell. The predetermined location is positioned so that an upper portion of the absorbent pad is exposed. The absorbent pad is typically 1¼ inches in height and 3¾ inches in width so that it can essentially wrap around the neck of the bottle. The bottom ¾ inch of the absorbent pad may be attached to the shrink-wrap shell while the top ½ inch of the absorbent pad is free from any attachment. The upper portion of the absorbent pad comprises a plurality of slits that are ¼ inch deep with the slits typically spaced ¼ inch apart forming a plurality of teeth. After the bottle is opened by pulling on the tab and separating the shrink-wrap shell extension from the lower portion of the shrink-wrap shell, the user may expand the teeth-like structure in the absorbent pad to capture the drips formed during pouring of wine or liquid from the bottle more effectively. The teeth of the absorbent pad absorb the first drips, while subsequent drips travel along the slits and are captured by the lower portion of the absorbent pad. Although use of a plurality of slits or teeth readily absorb the first liquid drips and are especially preferred, it should be understood by those skilled in the art that the absorbent pad can be effectively deployed to absorb the drips even though it is not provided with the plural tooth or slit configuration. The absorbent pad thus has sufficient capacity to absorb all the drips created during pouting of wine or liquid from the bottle, preventing damage to a table cloth or table cover on which the wine or liquid containing bottle is placed.

The Integrated Drip Proof Stopper system is easy to install during manufacture of a bottle filled with wine or other liquids. It is attractive because the absorbent pad is completely hidden from view until the bottle is opened by pulling the tab attached to the shrink-wrap shell. It is easy to use and effectively captures all the drips created during pouring of the wine or liquid. The user may open the teeth of the upper portion of the absorbent pad to increase its drip-capturing efficiency.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

The present invention provides an integrated drip proof stopper for wine bottles and other liquid containers that help prevent wine or other liquids from dripping off a bottle during and after pouring the liquid from the bottle. The Integrated Drip Proof Stopper System comprises a shrink-wrap shell which overlies an absorbent pad. The absorbent pad is revealed by the removal of a shrink-wrap shell extension using an opening component.

Figure 1:
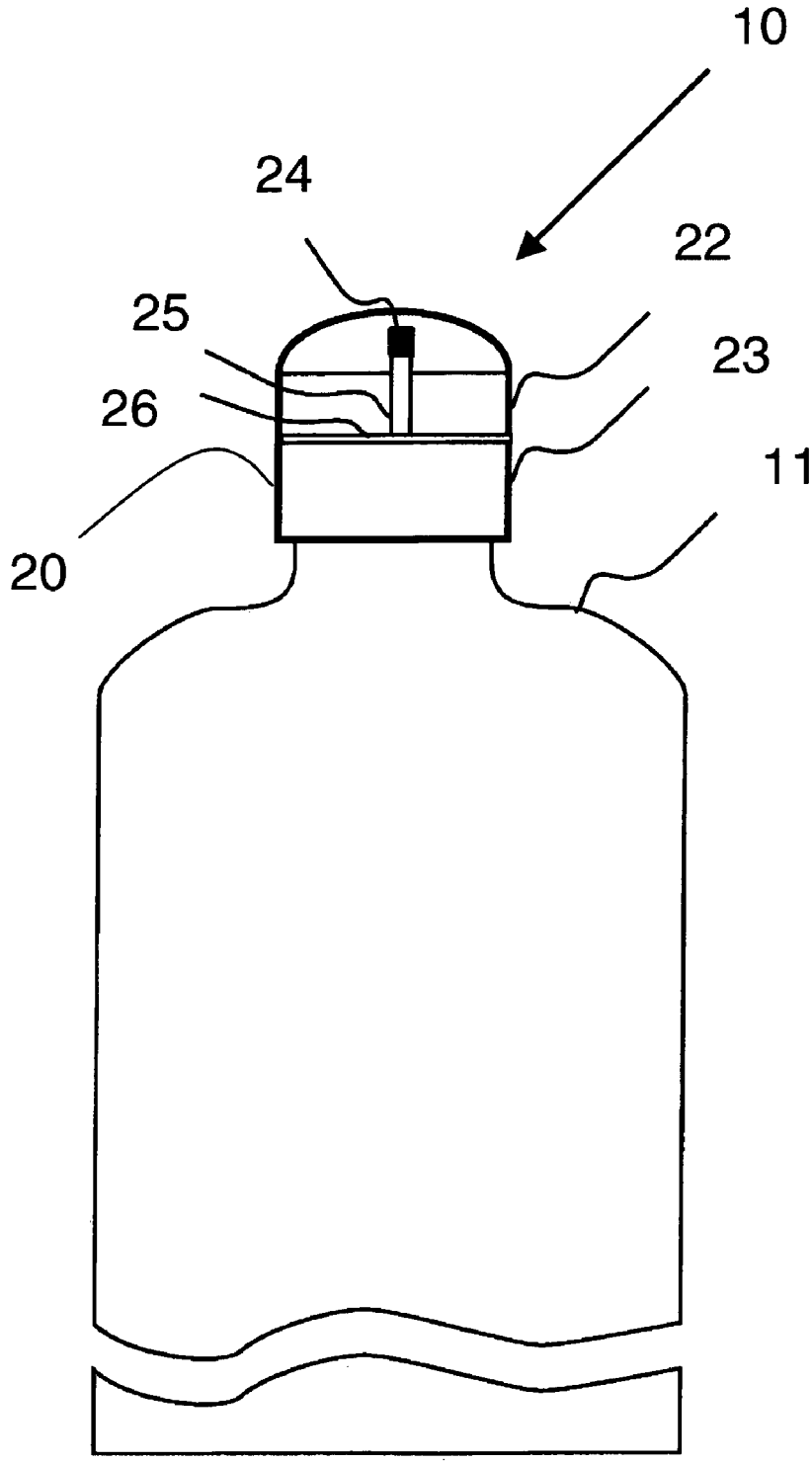
FIG. 1 is a schematic representation of the Integrated Drip Proof Stopper system.

Referring to FIG. 1 and FIG. 2*a-d*, the integrated drip proof stopper, shown generally at 10, is adapted to fit around the neck of a bottle 11. Advantageously, the Integrated Drip Proof Stopper System may be installed on the bottle during the bottling operation. The system includes an absorbent pad 30, which may be hidden from view by the shrink-wrap shell extension 22 of the shrink-wrap shell 20. The absorbent pad 30 is exposed following the removal of the shrink-wrap shell extension using an opening component. FIG. 1 shows the opening component as a tab 24 which is pulled by a user resulting in the separation of the tab from the remaining shrink wrap shell 20 through the tearing of the tab along a vertical perforation 25 in the shrink-wrap shell, the vertical perforation running parallel to the long axis of the wine or liquid bottle. The vertical perforation intersects a horizontal perforation 26 that extends perpendicular to the long axis of the wine or liquid bottle. In configurations wherein the tab is attached to a strip located beneath the shrink-wrap shell, the tearing action is readily accomplished without need of the vertical and horizontal perforations 25 and 26. Continuing to pull on the tab 20 results in the separation of the shrink-wrap shell extension 22 from the lower portion of the shrink-wrap shell 23, exposing the absorbent pad 30. The novel construction of the Integrated Drip Proof Stopper System operates to provide improved absorption of wine drops from the bottle, thereby preventing drops of liquid from migrating down the neck of the bottle and coming into contact with the surface of a table, or other substrate, therebelow. Typically, the absorbent pad 30 is composed of a low cost material having long absorbing fibers, such as felt, blotting paper, chamois or the like. The wine or liquid drip absorption capability of the Integrated Drip Stopper Proof System is sufficient to absorb all drips that may be produced due to the adsorption pad's dimensions and geometry of construction.

Figure 2A:
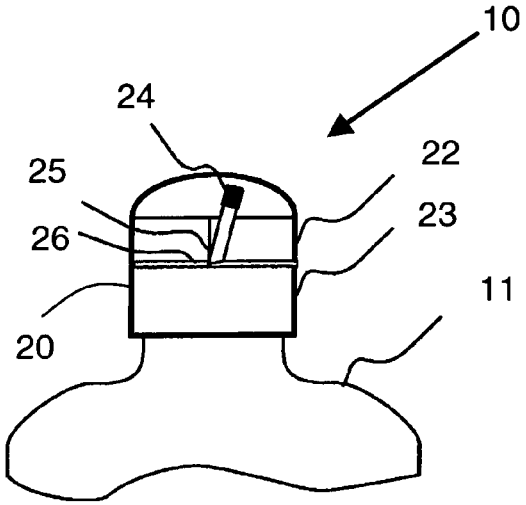
FIG. 2 illustrates the bottle opening process at different stages.
Figure 2B:
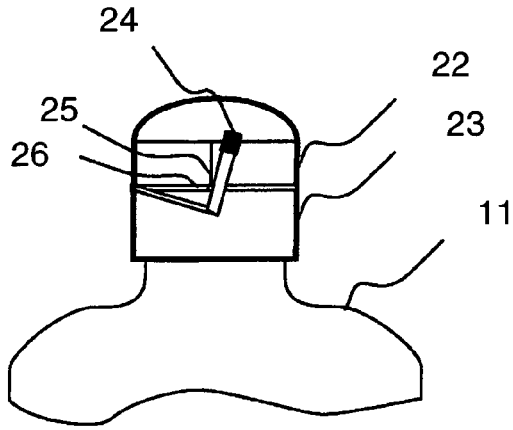
Figure 2C:
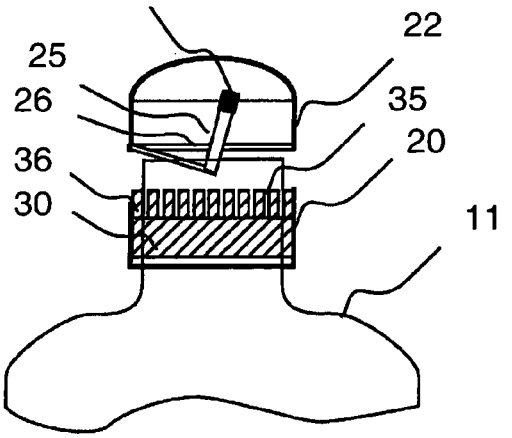
Figure 2D:
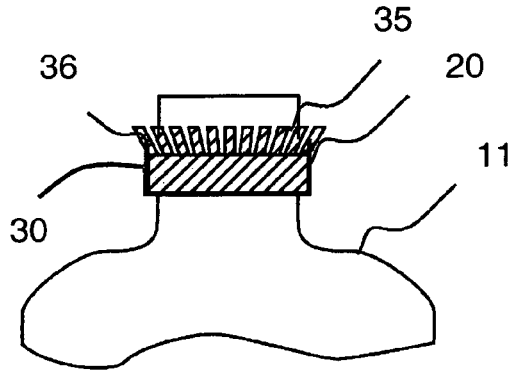

FIG. 2*a-d* illustrates the different stages in the removal of the shrink-wrap shell. In FIG. 2*a* the tab 24 is pulled to initiate a tear along the vertical perforation 25. In FIG. 2*b*, the tear is extended circumferentially along the horizontal perforation 26, completely separating the shrink-wrap extension 22 from a lower portion of the shrink-wrap shell 23. FIG. 2*c* shows the shrink wrap shell extension 22 removed, exposing the absorption pad 30 which includes a plurality of slits 35 and teeth 36. FIG. 2*d* shows the teeth 36 pushed away from the bottle surface to facilitate the capture of drips running down the neck of the bottle.

Figure 3:
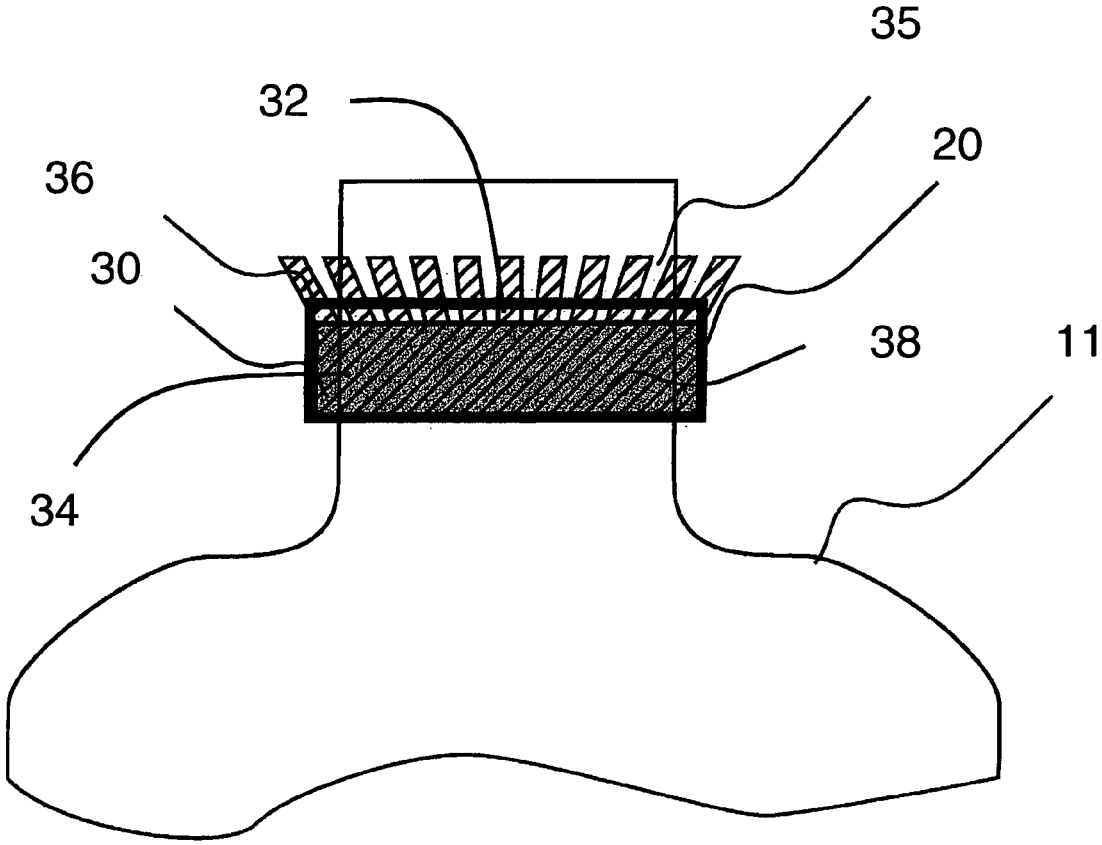
FIG. 3 illustrates the details of construction of the absorption pad within the shrink-wrap cylinder.

FIG. 3 illustrates the details of construction of the absorption pad 30 following the removal of the shrink-wrap shell 22. The upper portion of the absorption pad 32, revealed following the removal of the shrink-wrap shell extension, is preferably not attached to the shrink-wrap shell and comprises a plurality of slits 35 and teeth 36. The teeth 36 may be bent away from the wine or liquid bottle helping to collect drips running down the neck of the bottle. During the manufacture of the bottle, the shrink-wrap shell 20 is applied so that it completely covers the absorption pad 30. With this arrangement, the absorption pad 30 is not revealed until the shrink-wrap shell extension 22 is removed. Preferably, the lower portion of the shrink-wrap shell partially covers the upper portion of the absorbent pad 32. The shrink-wrap shell 20 and the absorption pad 30 are preferably not attached to the bottle, being merely held in place by friction, due to the force exerted on the bottle by the shrink-wrap shell. The absorbent pad is preferably attached to the shrink-wrap shell through a bonded region 38 located in the lower portion of the absorbent pad 34. The attachment of the absorbent pad 30 to the shrink-wrap shell 20 may be achieved through the use of glue, paste, tape, thread and any other means by which two materials may be held together. Preferably the attachment of the absorbent pad to the shrink-wrap shell is achieved through the use of a polymeric glue. In an alternate embodiment, the absorbent pad 30 is glued to the bottle, following which the shrink-wrap shell 20 is positioned thereabout and held in place by frictional engagement therewith.

In one embodiment the shrink-wrap shell 20 is approximately 2½ inches high, 3 and ¾ inches wide, while the absorbent pad 30 is approximately 1¼ inches high 3¾ inches wide. With these dimensions, the shrink-wrap shell 20 and the absorption pad 30 have sufficient height and width to surround the neck of a standard-size wine bottle. The upper portion of the absorbent pad 32 measures approximately ¼ inch and includes a plurality of slits 35 and teeth 36. The upper portion of the absorbent pad is exposed upon the removal of the shrink-wrap shell extension 22 while the remaining lower portion of the absorbent pad remains covered by the lower portion of the shrink-wrap shell 23. The upper portion of the absorbent pad is revealed by pulling the tab 24 downward and horizontally across the neck of the bottle removing the shrink-wrap shell extension. The absorbent pad 30 is held tightly against the neck of the bottle by the remaining bottom portion of the shrink-wrap shell 23. Preferably, the bonded region of the absorbent pad 38 is approximately ¼ inch in height.

After removing the shrink-wrap shell extension, the integrated drip proof stopper 10 is essentially ready for operation. The user simply pushes the teeth 36 of the exposed absorbent pad 30 outwardly, away from the bottle's neck, to create a structural arrangement of the drip stopper ideally suited to catch and absorb drips of wine migrating down the sides of the bottle. Additional drip of wine runs through the slits into the bottom portion of the absorbent pad. The region immediately below the slits may be scored to allow the teeth to remain bent after the teeth are pushed outward away from the bottle's neck.

Preferably the slits 35 are cut in the absorbent pad 30 in the vertical direction of the bottle for a distance of ¼ inch from the top surface. Each of the slits is spaced approximately ¼ inch apart. Alternatively, the upper portion of the absorbent pad 32 may be left uncut. The area represented by the width and the length of the absorbent strip is large enough to absorb drips that occur when pouring liquid form the bottle.

Preferably the absorbent pad overlies the neck of the bottle but is not attached to the bottle. Rather, it is held in place by friction, which is provided by the clamping action of the shrink-wrap shell. During manufacture of the bottled wine or liquid, the shrink-wrap shell is extended all the way around the enclosure of the bottle, and the absorbent pad is completely concealed within the shrink-wrap shell. An opening component is provided to facilitate opening of the bottle. Such opening component may comprise a tab attached to a strip disposed beneath the shrink-wrap shell extension. Pulling the tab, which is attached to the strip, essentially creates a cut initially within the shrink-wrap extension, parallel to the long axis of the bottle. In an alternative embodiment, wherein the tab is attached to a perforated portion of the shrink-wrap shell, a tear or cut is readily initiated in the shell by pulling on the tab. Thereafter, as the tab is pulled, the cut proceeds along a path perpendicular to the first cut. In a further embodiment, the tab and strip are combined with a perforated portion. With this embodiment, pulling on the tab initiates a tear that proceeds horizontally around the shrink-wrap shell. Thereafter, the user pulls upwardly on the shrink-wrap shell itself to extend the tear along a vertically disposed perforation that intersects the horizontally torn shrink-wrap shell portion. Such an embodiment eliminates the need for a strip extending vertically from a point of intersection with the horizontally disposed tab and strip. It is economical to manufacture using existing equipment and facilitates removal of the upper portion of the shrink-wrap shell. In this manner there is created a circumferential cut in the shrink-wrap extension at a pre-determined location, which essentially separates the shrink-wrap shell extension 22 from the lower portion of the shrink-wrap shell 23. The location of the circumferential cut is set at a position that reveals the upper portion of the absorbent pad 32 after the removal of the shrink-wrap shell extension.

Preferably, after pulling on the opening strip to expose the slits of the absorbent pad, the bottle is ready for use. The user then pushes the teeth of the upper portion of the absorbent pad outward, away from the bottle's neck, to create a structural arrangement of the drip proof stopper best suited to catch and absorb drips of wine or liquid migrating down the neck of the bottle. Wine or liquid dripping from the mouth of the bottle is first absorbed by the teeth of the upper portion of the absorbent pad, which extends above the shrink-wrap shell. Thereafter, the wine or liquid drops run through the plurality of slits into the lower portion of the absorbent pad 34 which underlies the lower portion of the shrink-wrap shell 23. At this point, the absorbent pad remains unattached to the shell or the bottle and efficiently absorbs the wine drops. Additional wine drops are absorbed by the bonded region 38 of the absorbent pad. Wine or liquid drops reaching this region are captured within the structure, preventing running down of the wine or liquid along the bottle surface. The wine or liquid drip absorption capability of the Integrated Drip Proof Stopper System is sufficient to absorb virtually all of the wine or liquid drops that may be produced, owing to the dimensions of the absorption pad provided and its geometry of construction.

This drip proof stopper design is especially suited for installation during the bottling operation. Once installed, the absorbent pad remains hidden beneath the shrink-wrap shell, which protects it during bottling and subsequent handling operations. Upon removal of the top shrink-wrap shell extension, the absorbent pad is already located in position to accomplish its drip mitigation function. The integrated drip proof stopper is attractive and can be readily adapted for use with a wide variety of liquid containing vessels, including bottles that contain olive oil, salad dressing sun tan lotion and the like. When installed on a liquid containing vessel, the integrated drip proof stopper functions to virtually eliminate migration of drips downwardly of the vessel's sides and into contact with a table surface, or other substrate, on which the vessel rests Degradation of tablecloths and surfaces beneath the bottle due to inadvertent contact by liquid spilt while serving beverages is substantially eliminated.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. An Integrated Drip Proof Stopper system comprising:

a. a shrink-wrap shell comprising a shrink-wrap shell extension and a lower portion, said shrink wrap shell forming a closure cap attached to a neck of a bottle;

b. an absorbent pad located underneath said shrink-wrap shell, said adsorbent pad including an upper portion and a lower portion;

c. said upper portion of said absorbent pad comprising a plurality of slits and teeth;

d. each tooth of said plurality of teeth being scored to allow the teeth to remain bent after the teeth are pushed outward away from said bottle's neck; and e. an opening component for removing said shrink-wrap shell extension to expose said absorbent pad.

2. An Integrated Drip Proof Stopper system as recited in claim 1, wherein said absorbent pad is composed of blotting paper.

3. An Integrated Drip Proof Stopper system as recited in claim 1, wherein said absorbent pad is composed of felt.

4. An Integrated Drip Proof Stopper system as recited in claim 1, wherein said upper portion of absorbent pad has slits cut to a height of ¼ inch spaced ¼ inch apart.

5. An Integrated Drip Proof Stopper system as recited in claim 1, wherein said absorbent pad is composed of chamois.

6. An Integrated Drip Proof Stopper system as recited in claim 1, wherein said absorbent pad is 1¼ inches in height and 3¾ inches in width.

7. An Integrated Drip Proof Stopper system as recited in claim 1, wherein said lower part of the absorbent pad is comprised of a bonded region, said bonded region forming an attachment with said lower portion of the shrink-wrap shell.

8. An Integrated Drip Proof Stopper system as recited in claim 1, wherein said bonded region of said lower portion of the absorbent pad is approximately ¼ inch in height.

9. An Integrated Drip Proof Stopper system as recited in claim 1, wherein said bonded region is attached to the shrink-wrap shell by a polymeric adhesive.

10. An Integrated Drip Proof Stopper system as recited in claim 1, wherein said shrink-wrap shell is composed of aluminum foil tape with adhesive backing.

11. An Integrated Drip Proof Stopper system as recited in claim 1, wherein said shrink-wrap shell is 2½ inches in height and 3¾ inches in width.

12. An Integrated Drip Proof Stopper system as recited in claim 1, wherein said opening component is a tab connected to a strip that is pulled by a user to remove the shrink-wrap shell extension.

13. An Integrated Drip Proof Stopper system as recited by claim 1, wherein said opening component comprises a strip, the outer portion of which extends to a point of protrusion beyond an edge of the shrink-wrap shell, said strip being pulled by a user to remove the shrink-wrap shell extension.

* * * * *